US009120599B2

(12) United States Patent
Shamoon et al.

(10) Patent No.: US 9,120,599 B2
(45) Date of Patent: Sep. 1, 2015

(54) DUAL CHAMBER DRINK CONTAINER

(71) Applicants: Ellis N. Shamoon, Dallas, TX (US); Thomas Bernerd Murphy, Arlington, TX (US)

(72) Inventors: Ellis N. Shamoon, Dallas, TX (US); Thomas Bernerd Murphy, Arlington, TX (US)

( * ) Notice: Subject to any disclaimer, the term of this patent is extended or adjusted under 35 U.S.C. 154(b) by 0 days.

(21) Appl. No.: 14/089,597

(22) Filed: Nov. 25, 2013

(65) Prior Publication Data

US 2015/0144516 A1 May 28, 2015

(51) Int. Cl.

*A47G 19/22* (2006.01)
*B65D 25/04* (2006.01)
*B65D 43/02* (2006.01)

(52) U.S. Cl.

CPC ..... *B65D 25/04* (2013.01); *A47G 19/2205* (2013.01); *B65D 43/0231* (2013.01); *B65D 2231/022* (2013.01); *B65D 2543/0024* (2013.01); *B65D 2543/00092* (2013.01); *B65D 2543/00296* (2013.01); *B65D 2543/00537* (2013.01); *B65D 2543/00972* (2013.01)

(58) Field of Classification Search

CPC ..... B65D 25/04; B65D 43/0231; B65D 2231/022; B65D 2543/00972; B65D 2543/00092; B65D 2543/00296; B65D 2543/0024; B65D 2543/00537

USPC ..... 220/525, 524, 553, 703, 705, 709, 507, 220/523, 526; 206/217; 215/387, 388, 229

See application file for complete search history.

(56) References Cited

U.S. PATENT DOCUMENTS

| | | | | |
|---|---|---|---|---|
| 43,154 | A | 6/1864 | Heneage | |
| 4,301,942 | A * | 11/1981 | Kupperman et al. | 220/592.17 |
| 4,955,503 | A * | 9/1990 | Propes | 220/526 |
| 6,283,316 | B1 * | 9/2001 | Sherman | 215/6 |
| 7,975,868 | B1 * | 7/2011 | Flies et al. | 220/524 |
| 2008/0000866 | A1 | 1/2008 | Yates | |
| 2012/0187066 | A1 * | 7/2012 | Redl | 215/11.2 |
| 2012/0199546 | A1 | 8/2012 | Dieni | |
| 2013/0001233 | A1 | 1/2013 | Hylton | |

OTHER PUBLICATIONS

Costa, Christen, Dual Chambered Water Bottle, GagetReview.com, Nov. 14, 2011 http://www.gadgetreview.com/2011/11/dual-chambered-water-bottle.html.

Swigz.com, Swigz Dual Hydration System, http://www.swigz.com/ May 2013.

HydraCup.com, Hydra Cup Dual Drink Container, http://www.hydracup.com May 2013.

* cited by examiner

*Primary Examiner* — Robert J Hicks
*Assistant Examiner* — Kareen Thomas
(74) *Attorney, Agent, or Firm* — Daniel V. Thompson

(57) ABSTRACT

A beverage container having at least two compartments separated by a partition, allowing the container to hold two separate liquids at once. A top open end of the container is secured via a rotatable threaded ring and a gasket fitted cap, the cap having two openings each positioned over a separate chamber, and with a means for securing the cap in a liquid-tight and secure fashion that ensures proper positioning of the cap openings over each compartment.

2 Claims, 6 Drawing Sheets

DUAL CHAMBER DRINK CONTAINER

TECHNICAL FIELD

The present invention relates to an improved liquid beverage container. More particularly, it is a dual-chambered liquid beverage container (hereinafter, dual-chamber drink container) that employs a novel means of fastening and removing a liquid-tight seal over the mouth of both chambers, while maintaining the orientation of each chamber's respective lid opening.

BACKGROUND OF THE INVENTION

Beverage containers with two separate and distinct compartments are unusual, but not unheard of in the marketplace. All known multi-chambered beverage containers are designed to contain two or more separate liquids, each in a separate compartment which comprises some portion of an overall container. The compartments are typically divided by a vertical partition that extends from the bottom of the container to the "mouth" of each compartment in order to keep the liquids in each compartment from comingling. This compartmental method of separating different liquids within the same container is not the subject of this disclosure, as it could be satisfactorily achieved by using one of several multi-chambered beverage container bodies already known in the public domain.

Most multi-chambered beverage containers employ a means for sealing off the "mouth" of each compartment to prevent spillage, by means of either a separate cap or lid that fits over each "mouth", or a "single cap" which seals all "mouths" simultaneously. In single cap embodiments the lid either snaps into place over the mouths of each compartment via a friction fit, or is screwed into place similar to a traditional beverage container cap. The problem with both of these methods is that they either fail to create a reliably liquid-tight seal between each compartment, or may have problems with orienting the openings for each compartment in the proper position. In prior art devices the user may be unable to create a reliable liquid-tight seal to prevent spillage, or the mouth openings may be inadvertently oriented over the partitions between the compartments.

There is a need, then, for a dual-chamber drink container that includes features that allow an easy to use cap that can reliably seal each compartment in a liquid-tight fashion, while ensuring that the openings for each compartment are positioned properly when the cap is sealed and tightened.

SUMMARY OF THE INVENTION

The dual-chamber drink container of the present invention includes a dual-chambered container with a vertical partition separating each chamber, a lid with two openings which fits over both chambers in a manner which orients each opening over each chamber in a specific and immobile position, and a gasket to complete the liquid-tight seal between each chamber and the lid. The engagement of the lid with the container is enabled by a threaded locking ring which interfaces with both the lid and the body of the container to secure the lid, gasket and container in a liquid-tight configuration.

BRIEF DESCRIPTION OF THE DRAWINGS

A more complete understanding of the invention and its advantages will be apparent from a review of the Detailed Description in conjunction with the following Drawings, in which.

DETAILED DESCRIPTION

Figure 1:
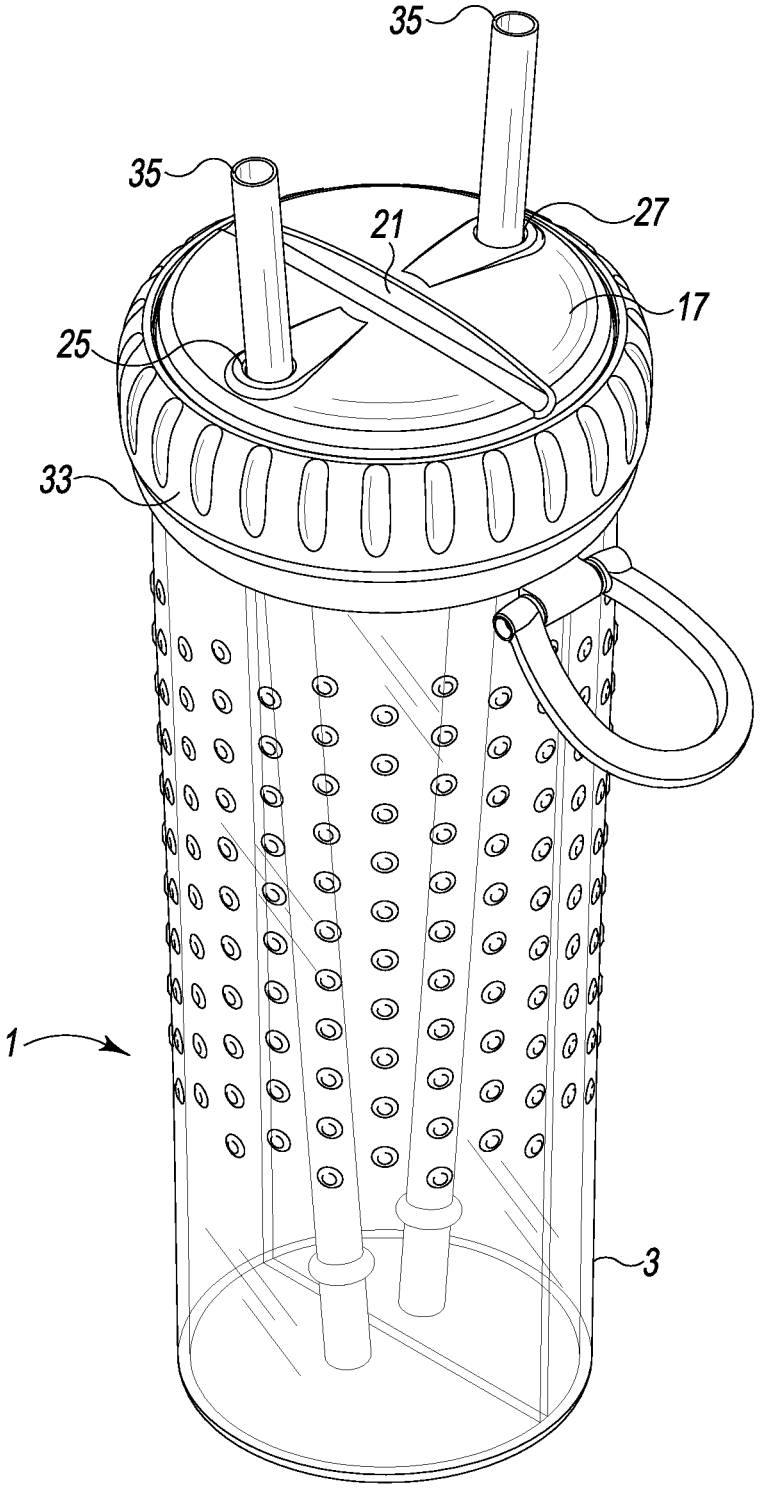
FIG. 1 is a perspective view of a dual-chamber drink container constructed in accordance with the invention.
Figure 2:
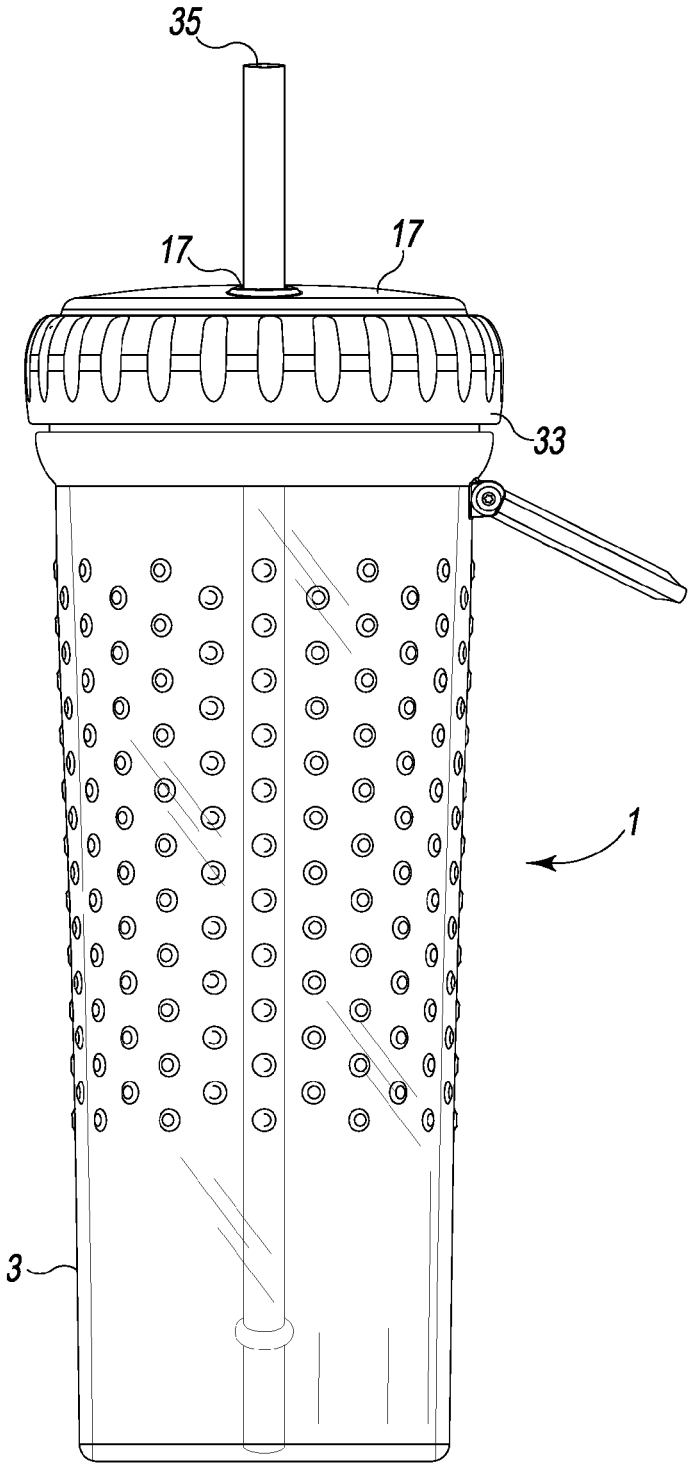
FIG. 2 is a side view of the dual-chamber drink container showing the container and the locking ring in a use configuration.
Figure 3:
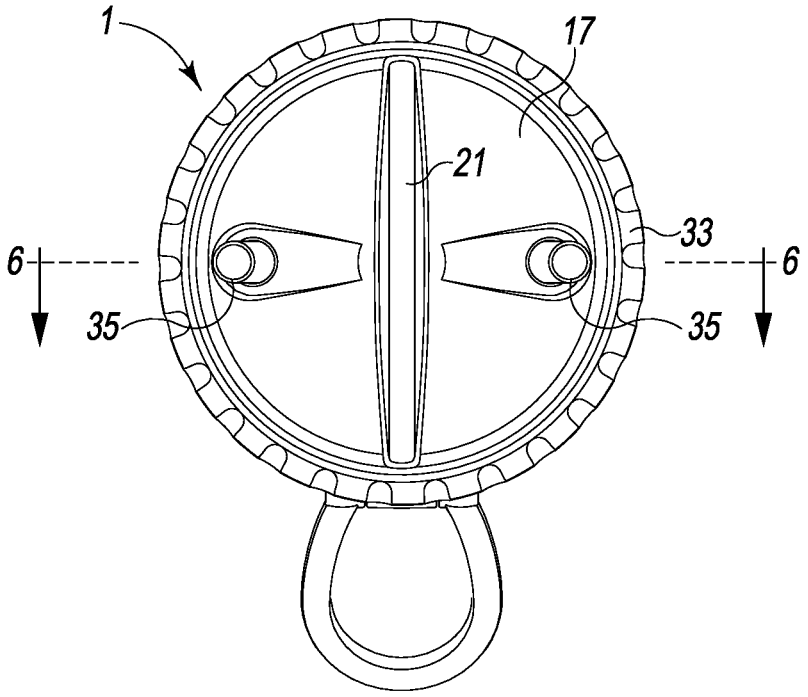
FIG. 3 is a top view of the dual-chamber drink container in the use configuration.

Referring initially to FIGS. 1-6, where like numerals indicate like and corresponding elements, a dual-chamber drink container 1 includes a container 3. Container 3 is generally cylindrical in shape, with two or more compartments 5, 7 (FIG. 4) divided by a vertical partition 9. Vertical partition 9 is irremovably coupled to the container and substantially the same height as the container, such that a circular upper container perimeter 11 is spanned by and in the same plane as a linear upper partition edge 13. A threaded neck 15 is located on the outside of the container 3 proximate to the upper container perimeter 11.

A lid member 17 includes a downwardly-facing socket 19, an upwardly-facing partition indicator 21, a gasket member 23, and two or more access openings 25, 27. Lid member 17 is positioned vertically over the upper container perimeter 11 of the container 3, and is generally circular with a diameter slightly larger than that of the container 3. The first opening 25 and second opening 27 are positioned over the first and second compartments 5, 7, respectively, of the container 3.

Figure 6:
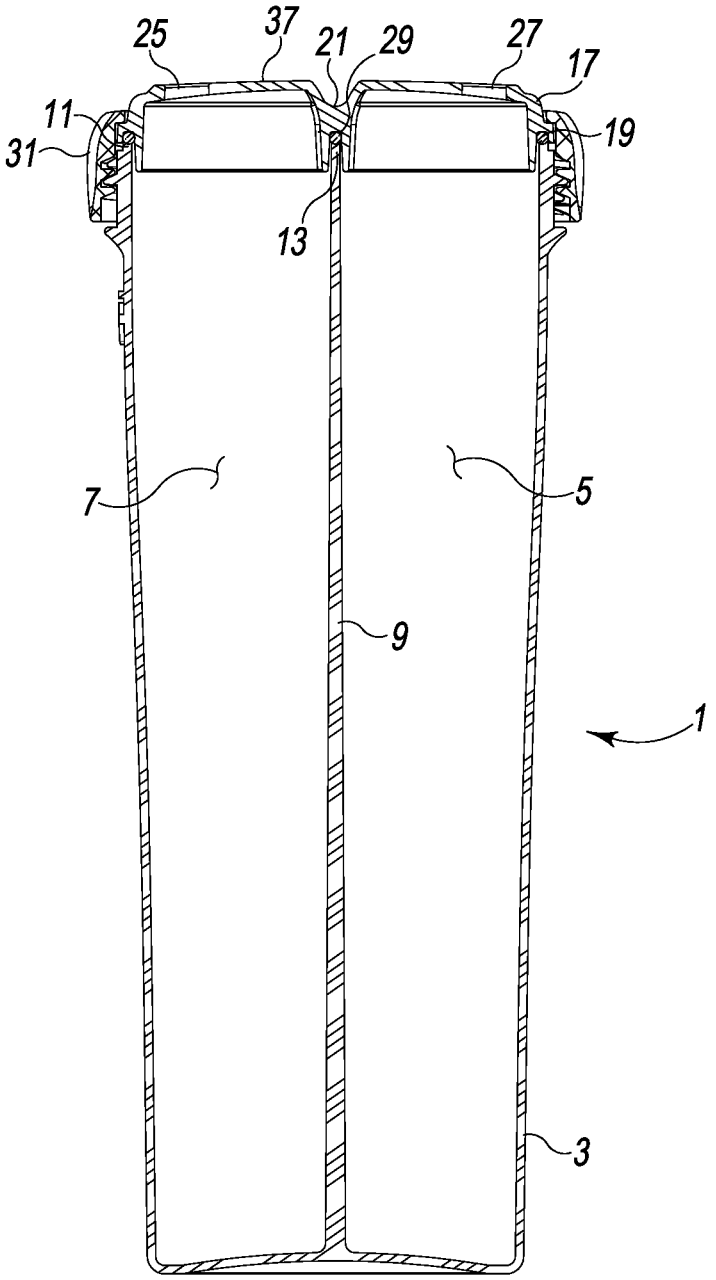
FIG. 6 is a sectional view of the dual-chamber drink container taken along line 6-6 of FIG. 3 showing the chamber partition, gasket member, lid member, and locking ring in the assembled configuration.

Socket 19 includes a center section 29 which engages the upper partition edge 13, as best shown in FIG. 6, only when the lid member 17 is properly registered with container 3. Partition indicator 31 is parallel to and vertically located above center section 29 when lid member 17 is properly registered.

Figure 4:
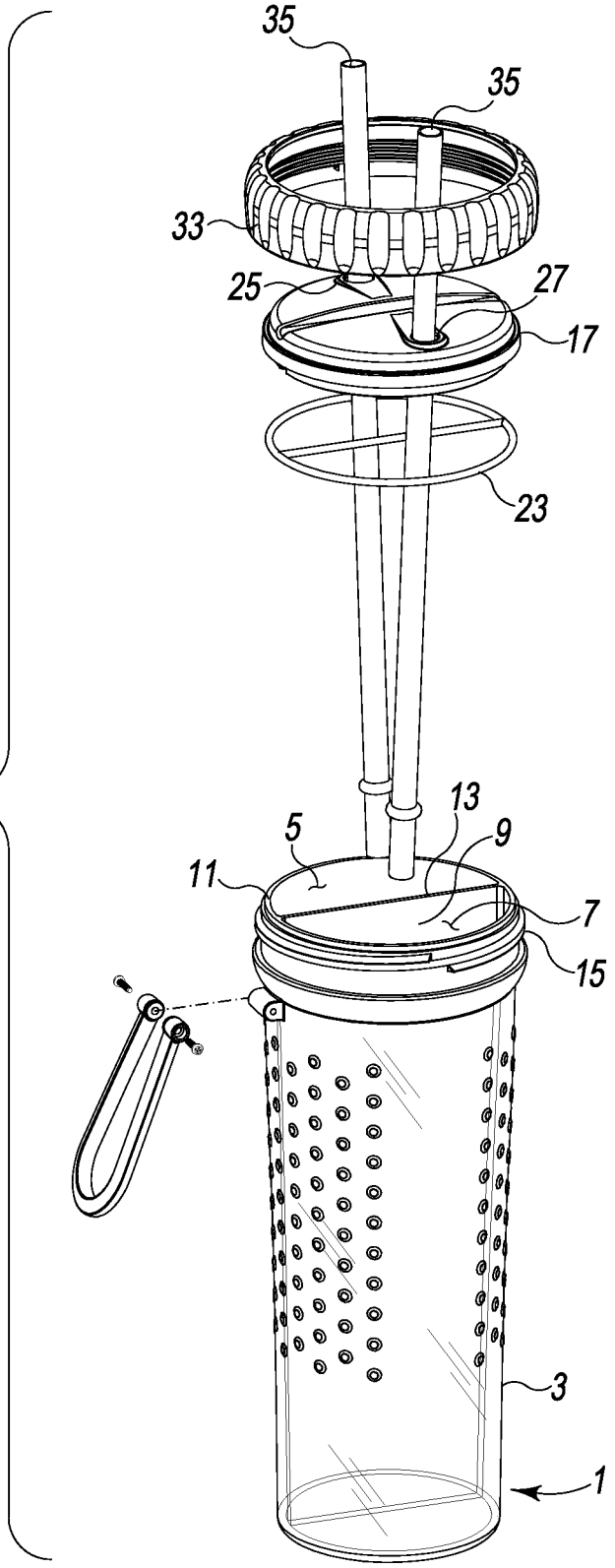
FIG. 4 is an exploded view of the dual-chamber drink container showing the chamber partition, gasket member, lid member, and locking ring in a disassembled configuration.
Figure 5:
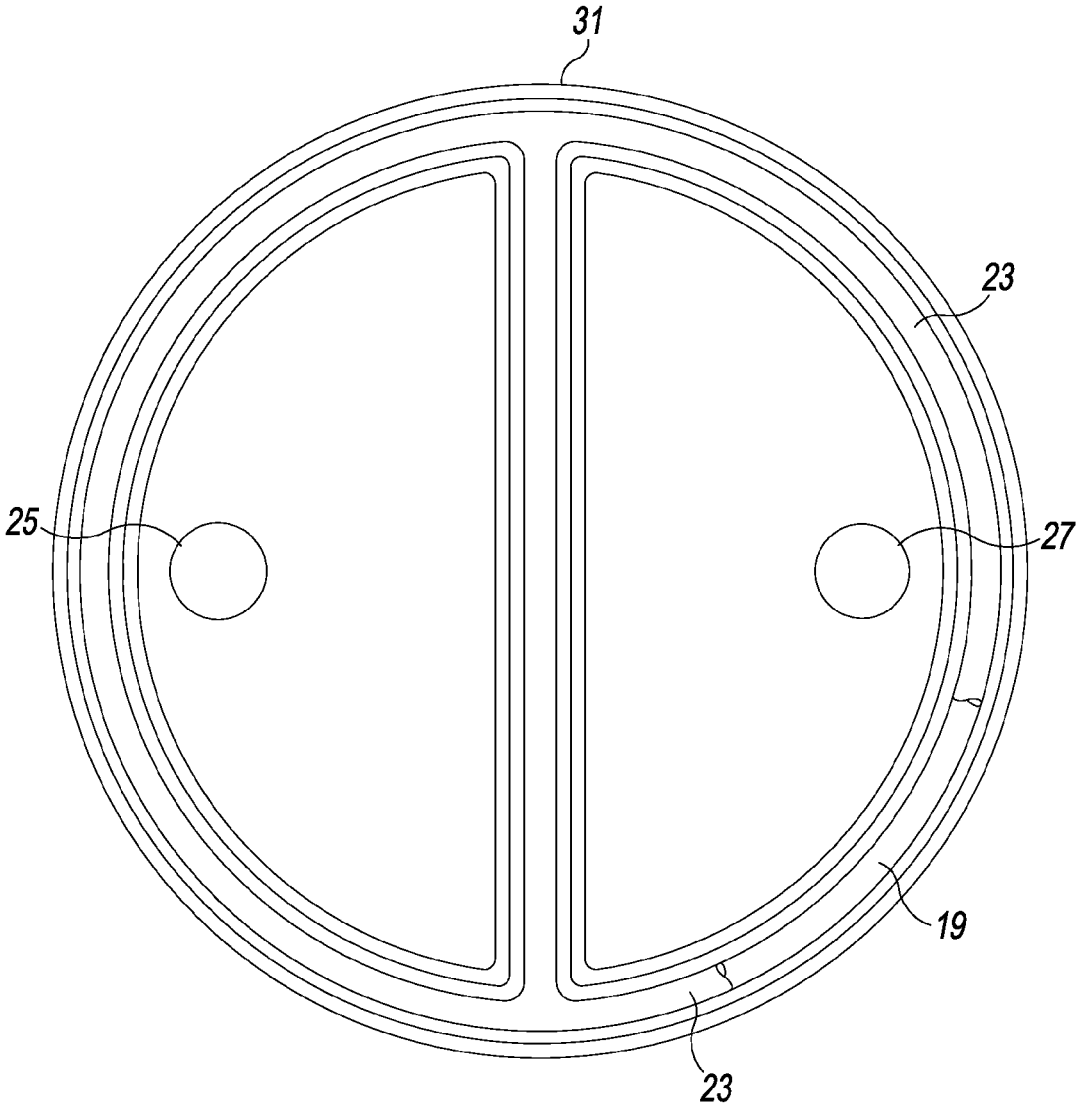
FIG. 5 is a partially broken-away bottom view of the lid member and gasket member in an assembled configuration, enlarged for clarity.

Gasket member 23 is shaped as a centrally-bisected circle, as best shown in FIG. 4, to closely interfit with socket 19 and center section 29 on an upper side and with upper container perimeter 11 and upper partition edge 13 on a lower side. The "sandwich" formed between the socket 19, gasket member 23, perimeter 11 and partition edge 13 enables a liquid-tight seal between the lid member 17 and container 3. Close interfitting between socket 19, perimeter 11 and partition edge 13, in combination with high clamping forces imparted by a locking ring 33, may enable gasket member 23 to be optional, with adequate sealing between the socket, container perimeter and partition edge enabled without it.

The threaded locking ring 33 is adapted to removably secure lid member 17 to threaded neck 15 when partition indicator 21 is aligned with upper partition edge 13, indicating that center section 29 has properly engaged upper partition edge 13.

In operation, when assembling the dual-chamber drink container 1 the user places the gasket member 23 and lid member 17 over the upper container perimeter 11 and upper partition edge 13. In the current embodiment the lid member 17 includes a socket 19 to help facilitate a liquid-tight seal between the lid member 17, upper partition edge 13 and upper container perimeter 11. The threaded locking ring 31 is then placed over the lid 17 and threaded neck 15 and removably screwed into place in a use configuration as shown in FIGS. 1-3 and 6. The first opening 25 and second opening 27 are positioned over the first and second compartments 5, 7, respectively. In the current embodiment each opening may facilitate an additional feature to aid in beverage consumption, such as a straw 35 as shown in FIGS. 1-4, or alternatively a valve, spigot or cap for sealing each opening 25, 27. The partition indicator 21 on an upper surface 37 of the lid member 17 aids the user in aligning the lid and gasket assembly in the proper position over the vertical partition 9. In this embodiment the partition indicator 21 is a depression which bisects the upper surface 37 of the lid member 17.

Though it is intended to fully describe the invention as set forth here, it is reasonable to assume that one skilled in the art could adjust, modify, subtract or adapt certain aspects of this dual-chamber drink container 1 device without departing from its original scope. The implementation of individual or combined improvements disclosed here as part of another dual-chamber drink container device is possible. For example, adding additional compartments to the dual-chamber drink container 1 device would be well within the bounds of what has been revealed herein. Other possible configurations of the dual-chamber drink container 1 may include a vertical partition 9 containing an insulating material to lessen thermal conductivity between compartments, or a container 1 with more than two segregated chambers 5, 7. The number of openings in the lid 17 and the configuration of the vertical partition 9 would need to be modified to accommodate additional compartments, as well as the shape of the gasket 3 to ensure a liquid-tight seal in the use configuration.

Various known configurations could be used to partition two or more liquids within a single container, or other features could be added to the lid openings such as spigots, valves or extruded caps. Again, these mechanisms are not the subject matter of this disclosure. The gist of this improved dual-chamber drink container is that in addition to an easy to use liquid-tight lid, the configuration is such that the openings for each chamber will be consistently positioned in a fixed configuration that ensures accessibility to each compartment while maintaining a liquid-tight seal.

The recommended materials will likely be, but are not limited to rigid plastic and synthetic rubbers.

While the invention has been illustrated and described as embodied, it is not intended to be limited to the details shown, since it will be understood that various omissions, modifications, substitutions and changes in the forms and details of the device illustrated in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A dual-chamber drink container comprising:

a container having a threaded neck and a circular upper container perimeter;

a vertical partition irremovably coupled to the container, wherein said partition separates the container into two or more compartments and has a linear upper partition edge, wherein the partition creates a liquid-tight barrier between each compartment, and wherein the upper partition edge spans and is coplanar with said upper container perimeter;

a lid member removably coupled to the container neck and vertical partition, wherein the lid member comprises an upper surface, two or more access openings in the upper surface, and a downwardly-facing socket;

the socket closely interfitted with the upper container perimeter and upper partition edge, wherein the socket includes a center section which engages the upper partition edge;

a threaded, open, locking ring removably coupled to the container and lid member, wherein the threaded ring member applies downward clamping force about the lid member when the threaded ring member is fitted over the lid member and screwed onto the threaded neck, the lid member upper surface being exposed when said locking ring is coupled to the container;

a gasket member removably coupled to the upper container perimeter, upper partition edge, and lid member socket;

the gasket member being shaped as a centrally-bisected circle, to closely interfit with the socket and center section on an upper side and with upper container perimeter and upper partition edge on a lower side, such that the assembly of the socket, gasket member, perimeter and partition edge enables a liquid-tight seal between the lid member and container; and wherein the upper surface of the lid member incorporates an upwardly-facing partition indicator which is parallel to, and directly above the upper partition edge.

2. The dual-chamber drink container of claim 1 with the partition indicator being a depression which bisects the upper surface of the lid member.

* * * * *